US008435004B1

(12) United States Patent
Liang

(10) Patent No.: US 8,435,004 B1
(45) Date of Patent: May 7, 2013

(54) TURBINE BLADE WITH TIP RAIL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 682 days.

(21) Appl. No.: 12/759,121

(22) Filed: Apr. 13, 2010

(51) Int. Cl.
*F01D 5/18* (2006.01)

(52) U.S. Cl.
USPC ..... 416/97 R; 416/92

(58) Field of Classification Search ..... 416/92, 416/96 R, 97 R; 415/115
See application file for complete search history.

(56) References Cited

U.S. PATENT DOCUMENTS

| | | | | |
|---|---|---|---|---|
| 5,997,251 | A * | 12/1999 | Lee | 416/97 R |
| 7,118,342 | B2 * | 10/2006 | Lee et al. | 416/97 R |
| 8,083,484 | B2 * | 12/2011 | Hatman | 416/92 |
| 2009/0324422 | A1 * | 12/2009 | Klasing et al. | 416/97 R |

* cited by examiner

*Primary Examiner* — Ninh H Nguyen
(74) *Attorney, Agent, or Firm* — John Ryznic

(57) ABSTRACT

A turbine rotor blade with a squealer pocket formed by tip rails on the blade tip. A row of tip cooling holes extend along an inner side of the tip rails on the pressure side and the suction side to provide cooling for the blade tip and limit leakage flow across the blade tip gap. A number of vortex flow blockers are positioned within the squealer pocket and extend from the tip rails and into the squealer pocket beyond the tip cooling holes to block any formation of vortex flow from the cooling air discharged through the tip cooling holes. The tip rail crown can be narrower such that a tip crown knife edge is formed. The tip cooling holes are slanted toward the tip rails to discharge cooling air toward the blade tip gaps.

10 Claims, 5 Drawing Sheets

TURBINE BLADE WITH TIP RAIL COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically a turbine rotor blade with tip rail cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

High temperature turbine blade tip section heat load is a function of the blade tip leakage flow. A high leakage flow will induce a high heat load onto the blade tip section. Thus, blade tip section sealing and cooling have to be addressed as a single problem. A prior art turbine blade tip design is shown in FIGS. 1-3 and includes a squealer tip rail 11 that extends around the perimeter of the airfoil flush with the airfoil wall to form an inner squealer pocket 12. The main purpose of incorporating the squealer tip in a blade design is to reduce the blade tip leakage and also to provide for improved rubbing capability for the blade. The narrow tip rail 11 provides for a small surface area to rub up against the inner surface of the blade outer air seal (BOAS) that forms the tip gap. Thus, less friction and less heat are developed when the tip rubs.

Traditionally, blade tip cooling is accomplished by drilling holes into the upper extremes of the serpentine coolant passages formed within the body of the blade from both the pressure and suction surfaces near the blade tip edge and the top surface of the squealer cavity. In general, film cooling holes are built in along the airfoil pressure side and suction side tip sections (P/S film holes 15 in FIG. 2 and S/S film holes 16 in FIG. 3) and extend from the leading edge to the trailing edge to provide edge cooling for the blade squealer tip. Also, convective cooling holes 14 also built in along the tip rail 11 at the inner portion of the squealer pocket provide additional cooling for the squealer tip rail. Since the blade tip region is subject to severe secondary flow field, this requires a large number of film cooling holes that requires more cooling flow for cooling the blade tip periphery. FIG. 1 shows the prior art squealer tip cooling arrangement and the secondary hot gas flow migration around the blade tip section. FIG. 2 shows a profile view of the pressure side with tip film cooling holes 15 and FIG. 3 shows the suction side each with tip peripheral film cooling holes 16 for the prior art turbine blade of FIG. 1.

The blade squealer tip rail 11 is subject to heating from three exposed side: 1) heat load from the airfoil hot gas side surface of the tip rail, 2) heat load from the top portion of the tip rail, and 3) heat load from the back side of the tip rail. Cooling of the squealer tip rail by means of discharge row of film cooling holes along the blade pressure side and suction peripheral and conduction through the base region of the squealer pocket becomes insufficient. This is primarily due to the combination of squealer pocket geometry and the interaction of hot gas secondary flow mixing. FIG. 1 shows the secondary flow 17 passing over the blade tip and a vortex flow 18 generated on the blade suction side surface. The effectiveness induced by the pressure film cooling and tip section convective cooling holes become very limited.

FIGS. 4 and 5 show a prior art turbine blade with a tip rail cooling design. A row of pressure side film cooling holes 15 are located on the pressure side wall of the blade and below the pressure side tip rail discharges a film layer of cooling air slightly upward and out onto the surface of the pressure side wall to flow over the pressure side tip rail as seen in FIG. 5. A similar row of suction side film cooling holes 16 is located on the suction side wall. Two tip rail convective cooling holes 14 discharge cooling air into the squealer pocket 12 and produce a vortex flow 19 of the cooling air as represented by the swirling arrows in both FIGS. 4 and 5. The vortex flows 19 follow a path from the upstream most hole 14 in the squealer pocket all the way to the opening in the squealer pocket along the pressure side wall in the trailing edge region of the blade tip as seen in FIG. 5. These two rows of tip rail convective cooling holes 14 are located adjacent to the inner sides of the tip rails. In the FIG. 4 tip rail design of the prior art, the vortex flow develops on the inner sides of both tip rails and travels along the inner side from the leading edge to the trailing edge of the tip pocket. These vortex flows 19 roll along the tip rails 11 from the leading edge toward the trailing edge and mix with the cooling air discharged from the tip floor convection cooling holes 14 and therefore reduce the cooling effectiveness of the backside cooling of the tip rails 11.

BRIEF SUMMARY OF THE INVENTION

A turbine rotor blade with a squealer pocket formed by tip rails extending around the blade tip, and with rows of convection cooling holes opening into the squealer pocket and extending along the insides of the pressure side and suction side tip rails. To prevent the formation of vortex flow along the inside walls of the tip rails to the hot gas flow leakage across the blade tip and the discharge of cooling air from the tip cooling holes, a series of vortex flow blockers are formed along the tip rails on the inside with several tip cooling holes located between adjacent vortex flow blockers to create an effective way for cooling and sealing the blade tip rails and to reduce the blade tip rail metal temperature.

The tip rails have a narrower tip crown surface than in the prior art in order to reduce the heat load for the tip rails and to lower the discharge coefficient for the tip gap and thus reduce the tip leakage flow across the tip rails. The tip cooling holes are then slanted toward the tip rails within the squealer pocket so that the cooling air discharged from the tip holes will flow against the incoming hot gas leakage on the pressure side tip rail and push the leakage toward the BOAS on the suction side tip rail. Both flow cooling air jets further reduce the total leakage flow across the blade tip and yield a very effective seal.

DETAILED DESCRIPTION OF THE INVENTION

Figure 1:
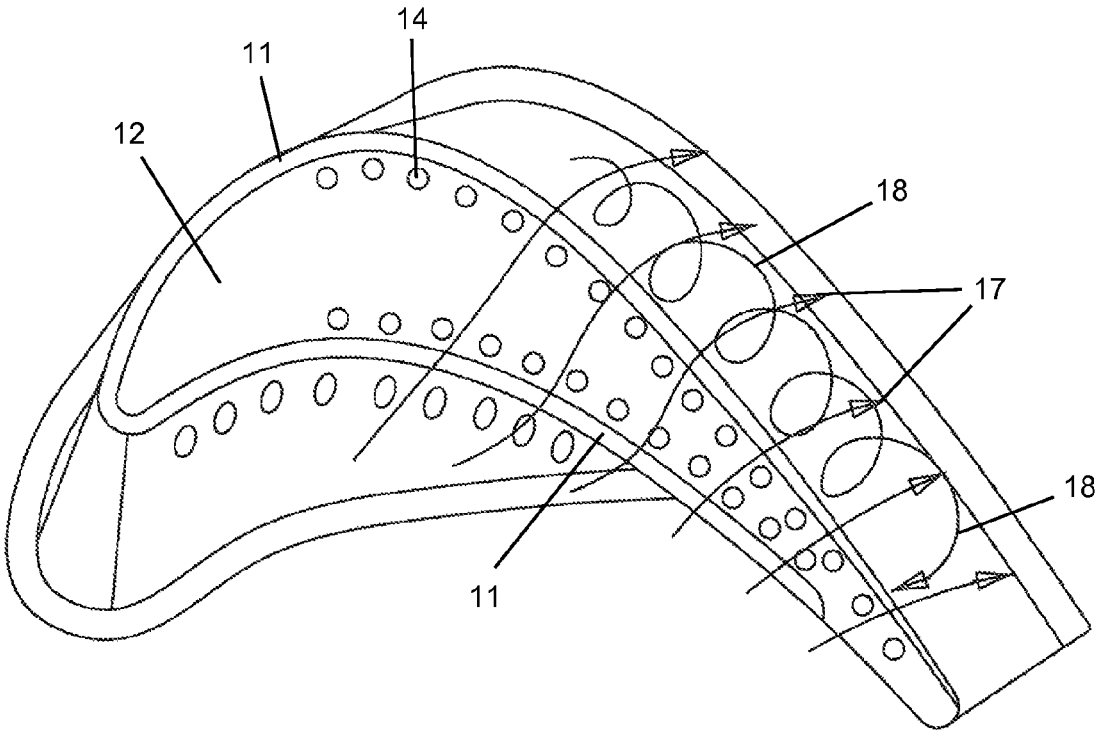
Fig 1 prior art
FIG. 1 shows a prior art blade tip with a squealer pocket and the secondary flow and tip cooling hole arrangement.
Figure 2:
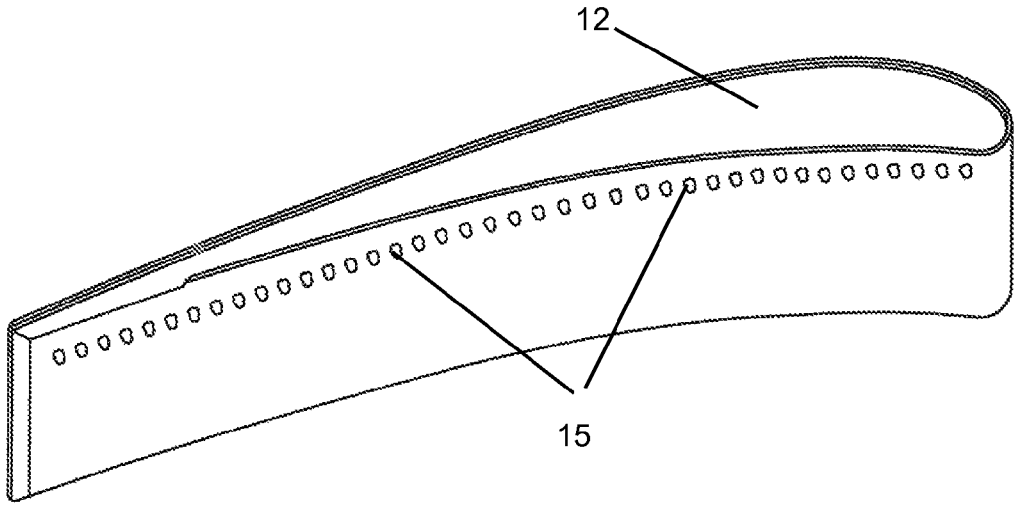
Fig 2 prior art
FIG. 2 shows a pressure side tip peripheral film cooling hole arrangement for a prior art blade.
Figure 3:
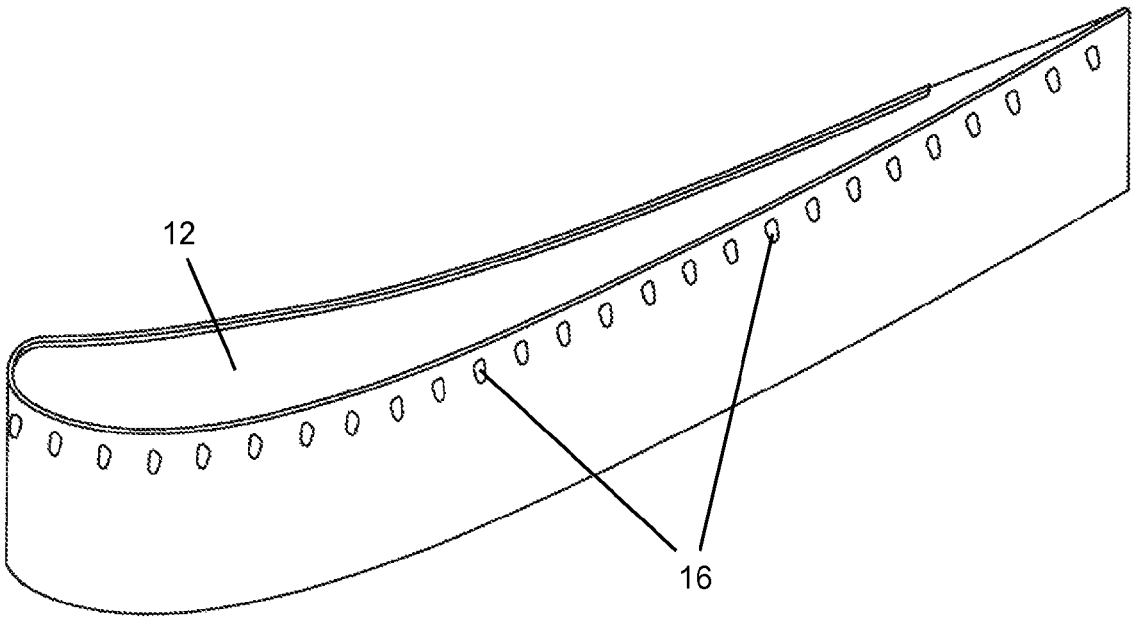
Fig 3 prior art
FIG. 3 shows a suction side tip peripheral film cooling hole arrangement for a prior art blade.
Figure 4:
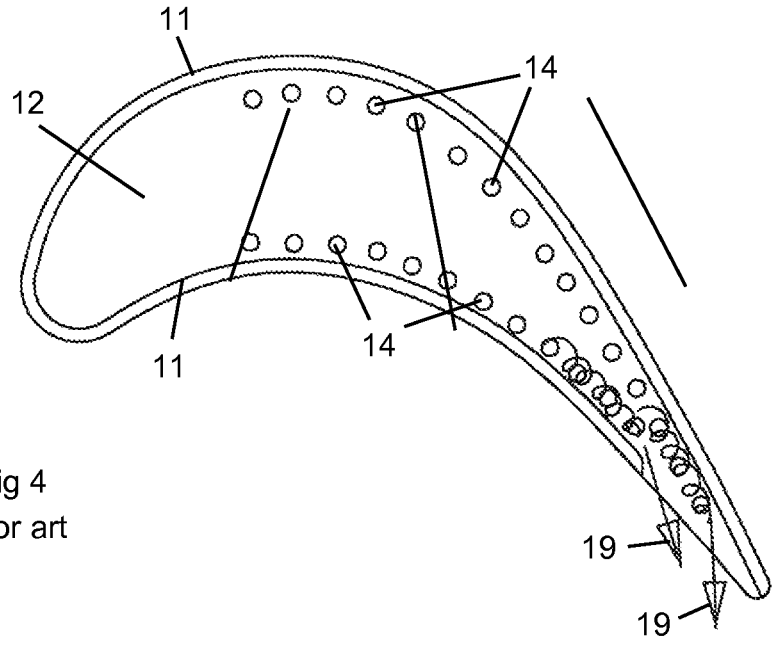
Fig 4 prior art
FIG. 4 shows a prior art blade tip with a squealer pocket and tip cooling holes with a vortex flow along the two rows of tip cooling holes.
Figure 5:
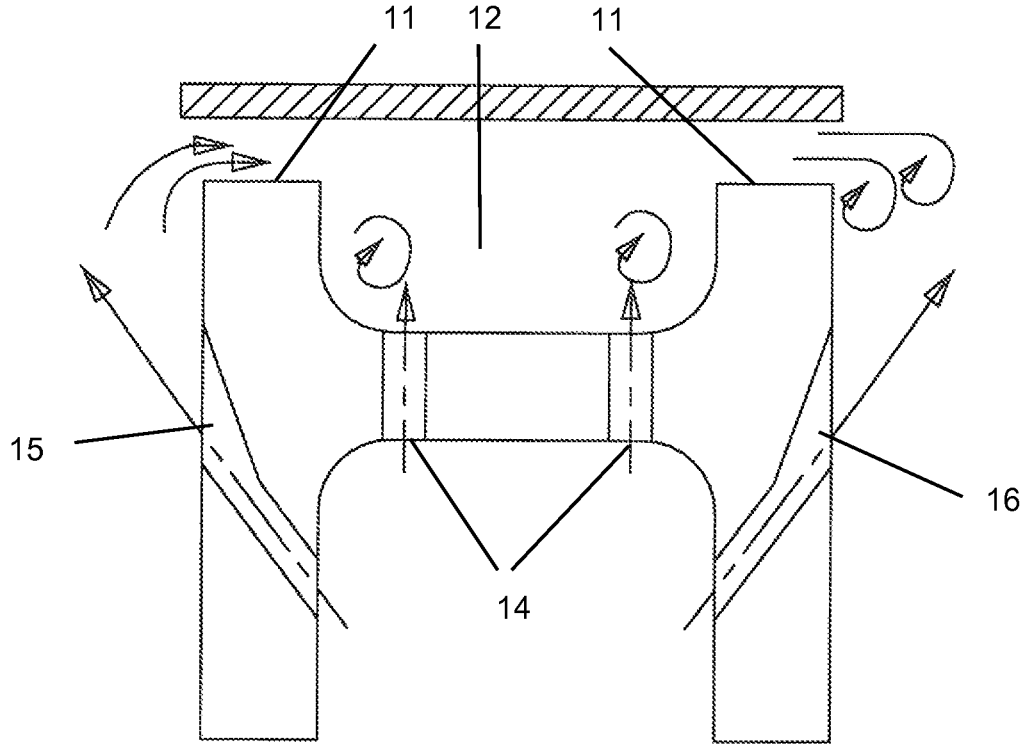
Fig 5 prior art
FIG. 5 shows a cross section of the blade of FIG. 4 with the film cooling holes and the tip cooling holes for the squealer pocket.
Figure 6:
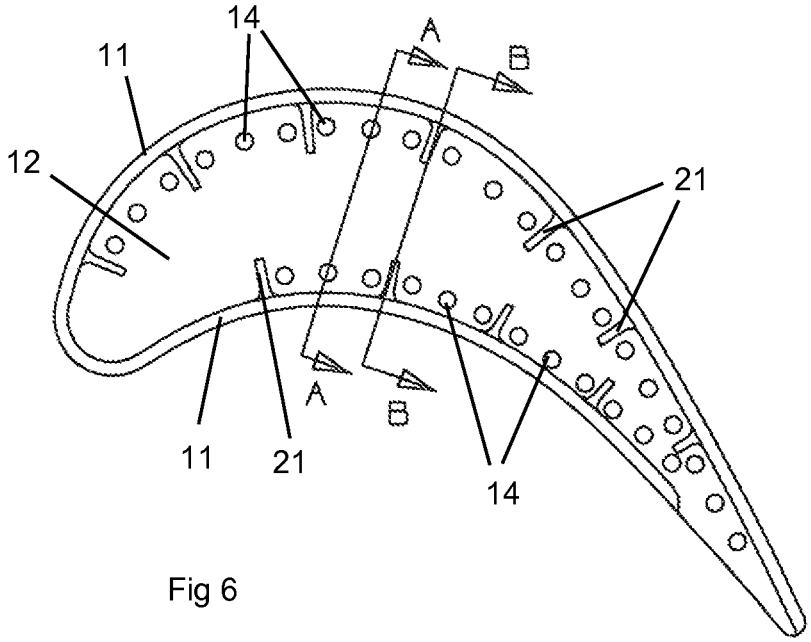
FIG. 6 shows a top view of a blade tip with a squealer pocket for the present invention.
Figure 7:
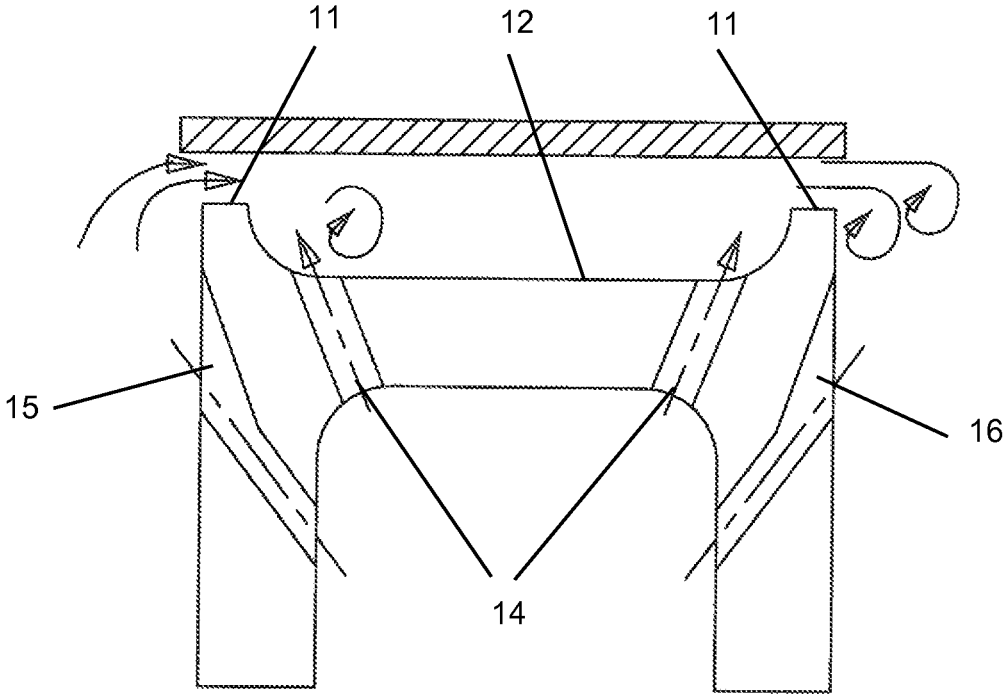
FIG. 7 shows a cross section view along the line A-A in FIG. 6 of the blade tip and squealer pocket of the present invention.
Figure 8:
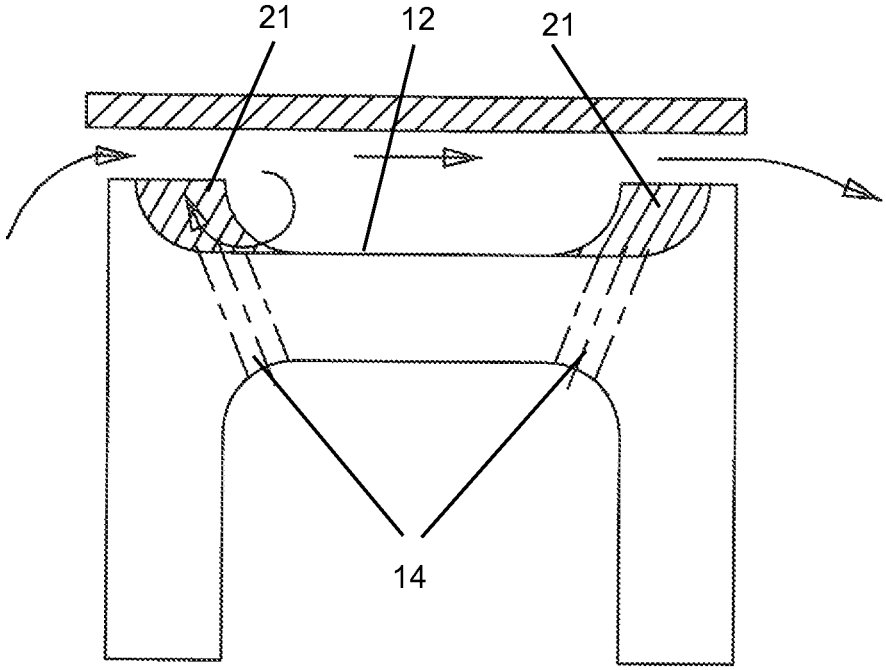
FIG. 8 shows a cross section view along the line B-B in FIG. 6 of the blade tip and squealer pocket of the present invention.

A turbine blade for a gas turbine engine, especially for an industrial gas turbine engine, where the blade tip includes a squealer pocket formed by tip rails extending around the periphery of the blade tip. FIGS. 6 through 8 show the turbine blade of the present invention with a squealer pocket 12 formed by tip rails extending around the pressure sand suction sides and the leading edge, and two rows of tip convection cooling holes 14 extending along the P/S and S/S inner walls of the tip rails 11. In order to prevent the formation of the vortex flows 19 developed in the prior art blade tip cooling design, the applicant makes use of vortex flow blockers 21 spaced around the blade tip. The vortex flow blockers extend from the inner wall of the tip rails 11 and project just inside of the row of tip cooling holes 14 so that formation of the vortex flow discussed in the prior art is prevented.

The vortex flow blockers 21 are spaced so that around 4 tip cooling holes are located between adjacent blockers 21. More holes can be placed between blockers 21 if the formation of the vortex flow is prevented. FIG. 7 shows a cross section through the blade tip through the line A-A in FIG. 6 passing through the tip cooling holes. The tip rail crown (top surface of the tip rail) is narrower than in the prior art and forms a knife edge like tip crown in order to reduce the heat load for the tip rail and to lower the discharge coefficient for the tip gap and thus reduce the tip leakage flow across the tip rail. FIG. 8 shows a cross section through the blade tip through line B-B which passes through two of the vortex flow blockers 21 with one on the P/S and the other on the S/S of the tip rails. The flow blocker 21 extends from the tip crown and out into the squealer pocket and then curves down to merge with the tip floor. As seen in FIGS. 7 and 8, the tip cooling holes slant towards the inner side of the tip rails so that the cooling air is discharged toward the incoming leakage flow on the pressure side tip rail and push the leakage flow toward the BOAS on the suction side of the tip rail.

In operation, the vortex flow that normally flows along the inner corner of the tip rail will be blocked off by the flow blockers 21. The corner vortex will no longer flow along the tip rail inner corner in the chordwise direction and mix with the newly ejected cooling air. Since the P/S and S/S film cooling holes are positioned on the airfoil periphery tip portion, the cooling air exiting the film cooling holes is in the same direction as the vortex flow over the blade tip from the P/S wall top the S/S wall of the blade tip. This results in the cooling air that is discharged from the backside convection cooling holes is retained within the tip rail. Because the tip cooling holes are slanted toward the inner side of the tip rails, the cooling air discharged will flow against the incoming leakage flow on the P/S tip rail and push the leakage toward the BOAS on the S/S of the tip rail. Both flow cooling air jets further reduce the total leakage flow across the blade tip and yield a very effective sealing arrangement.

The vortex flow blockers 21 also function as stiffeners for the blade tip crown. The recirculation of cooling air within the vortex flow blocker 21 will retain the cooling air for a longer period of time and therefore enhance the tip rail backside convective cooling efficiency. The reduction of the tip crown width will reduce the hot gas convective surface area from the top portion of the tip rail as well as the backside of the blade tip rail. This results in a reduction of the heat load from the tip crown and the backside of the backside of the blade tip rail. The contoured tip rail also reduces the effective conduction thickness for the blade tip rail and brings the cooling air closer to the backside of the tip rail, increasing the effectiveness of the backside convection cooling as well as the effectiveness of the TBC on the blade external periphery.

I claim the following:

1. A turbine rotor blade comprising:

a pressure side wall and a suction side wall;

a squealer pocket formed on the blade tip with a tip rail extending around the pressure side wall and the suction side wall;

a row of pressure side film cooling holes located on the pressure side wall and just below the tip rail;

a row of tip cooling holes opening into the squealer pocket and adjacent to the inner side of the tip rail on the pressure wall side; and, a plurality of vortex flow blockers positioned between a plurality of the tip cooling holes such that a vortex flow resulting from cooling air discharging from the tip cooling holes does not form.

2. The turbine rotor blade of claim 1, and further comprising:

the vortex flow blockers extend from an inner side of the tip rail and into the squealer pocket and just beyond the row of tip cooling holes.

3. The turbine rotor blade of claim 1, and further comprising:

the tip rail includes a thin tip crown such that a knife edge is formed.

4. The turbine rotor blade of claim 1, and further comprising:

the vortex flow blockers extend along the entire row of tip cooling holes.

5. The turbine rotor blade of claim 1, and further comprising:

the vortex flow blockers have a flat top surface that is flush with the tip crown.

6. The turbine rotor blade of claim 5, and further comprising:

the vortex flow blockers have a inner side wall that is curved toward the squealer pocket and flush with the tip floor.

7. The turbine rotor blade of claim 1, and further comprising:

the squealer pocket includes a row of tip cooling holes located along the suction side tip rail; and, a plurality of vortex flow blockers are positioned between a plurality of the suction side wall tip cooling holes such that a vortex flow resulting from cooling air discharging from the suction side tip cooling holes does not form.

8. The turbine rotor blade of claim 7, and further comprising:

a row of tip cooling holes on the inner side of the suction side tip rail; and, the suction side tip cooling holes are slanted toward the suction side tip rail.

9. The turbine rotor blade of claim 1, and further comprising:

the tip cooling holes are slanted toward the tip rail such that the cooling air discharged will flow against an incoming hot gas stream leakage flow on the pressure side tip rail and push the leakage flow toward a BOAS on the suction side of the tip rail.

10. The turbine rotor blade of claim 1, and further comprising:

the squealer pocket is open on the pressure side wall in the trailing edge region such that the tip cooling air can flow out from the squealer pocket.

* * * * *